US006975225B2

(12) United States Patent
Privalov et al.

(10) Patent No.: US 6,975,225 B2
(45) Date of Patent: Dec. 13, 2005

(54) FIRE SUPPRESSION SYSTEM AND METHOD

(75) Inventors: George Privalov, Baltimore, MD (US); Alexander Z. Shakhutdinov, Moscow (RU)

(73) Assignee: Axon X, LLC, Baltimore, MD (US)

( * ) Notice: Subject to any disclaimer, the term of this patent is extended or adjusted under 35 U.S.C. 154(b) by 26 days.

(21) Appl. No.: 10/731,758

(22) Filed: Dec. 9, 2003

(65) Prior Publication Data

US 2004/0163827 A1 Aug. 26, 2004

Related U.S. Application Data

(60) Provisional application No. 60/432,393, filed on Dec. 9, 2002.

(51) Int. Cl.[7] ..... G08B 1/08; H04Q 7/00

(52) U.S. Cl. ..... 340/539.26; 340/539.25

(58) Field of Search ..... 340/539.26, 539.25, 340/539.27, 539.16, 577, 3.1; 348/14.05, 135, 143

(56) References Cited

U.S. PATENT DOCUMENTS 4,170,264 A 10/1979 Gibson ..... 169/24
4,276,939 A * 7/1981 Atack ..... 169/60
4,875,526 A 10/1989 Latino et al. ..... 169/24
5,200,735 A * 4/1993 Hines ..... 340/539.11
5,382,943 A * 1/1995 Tanaka ..... 340/539.22
5,717,379 A * 2/1998 Peters ..... 340/539.25
6,587,046 B2 * 7/2003 Joao ..... 340/539.14
6,819,237 B2 * 11/2004 Wilson et al. ..... 340/539.26

* cited by examiner

*Primary Examiner*—John Tweel, Jr.
(74) *Attorney, Agent, or Firm*—Larry J. Guffey

(57) ABSTRACT

An operator-directed system for suppressing fire within a remote, outdoor, industrial installation has: (a) a means for capturing at a prescribed frequency video images of the remote area, (b) a means of transmitting these images to the operator's location which is some distance from the remote location, (c) a means, adapted to utilize these transmitted images, for detecting fire within the remote area, (d) a means located at the remote location for discharging a fire suppressant over the area, and (e) a means, located at the operator's location and utilizing the transmitted images, for allowing the operator to control the flow and direction of the discharging of the fire suppressant in the remote area.

16 Claims, 2 Drawing Sheets

FIRE SUPPRESSION SYSTEM AND METHOD

CROSS-REFERENCE TO RELATED APPLICATION

This application claims the benefit of Provisional Patent Application No. 60/432,393, filed Dec. 9, 2002 by George Privalov and Alexander Z. Shakhutdinov. The teachings of this application are incorporated herein by reference to the extent that they do not conflict with the teaching herein.

BACKGROUND OF THE INVENTION

1. Field of the Invention

The present invention generally relates to electrical, condition responsive systems. More particularly, the present invention relates to fire suppression systems utilizing remotely controlled water or foam suppression systems and their methods of operation.

2. Description of the Related Art

Fighting large fires, particularly in environments where fires can spread rapidly, requires methods and equipment which have very quick response times. The time between the detection of fire and the instant when firefighting resources are fully put into service is often critical, especially when there is the potential of the fire spreading rapidly, such as at industrial petrochemical installations.

The amount of fire-fighting resources required to contain the fire at these installations may be directly proportional to the delay between the fire's first appearance and the beginning of the fire suppression operations. Meanwhile, the value of the property damage caused by in such fires is reportedly exponentially proportional to this delay. In such dangerous environments, the rapid application of a fire suppressant when any flames are initially detected provides for a much better chance of the fire's containment and suppression with the least involvement of fire-fighting resources, and as a result, a minimal amount of property damage.

Current automated fire suppression systems, which are common in the art of suppressing fires, have significant limitations. For example, their use is almost totally restricted to applications involving confined spaces. Such automated systems are ill suited for large outdoor installations.

Large outdoor installations are usually protected from fire by the use of mobile fire-fighting equipment. Example of this equipment include turret-type devices, called monitors, which allow a fire-fighter to operate fire suppressant nozzles, like water guns, from within the cabin of a vehicle. In general, these devices consist of a water or foam cannon that allows the movement of the nozzle in two perpendicular planes—vertical and horizontal. Motorized servo controls are connected, often with joystick manipulator devices, within the cabin of the fire-fighting vehicle. Companies such as AcronBrass (Wooster, Ohio) manufacture such devices.

Also known in the prior art are numerous remotely-operated fire-fighting vehicles, see U.S. Pat. Nos. 4,875,526 and 4,170,264. These vehicles are designed to penetrate into dangerous zones while minimizing the risk to human life.

Despite much prior art relating to fire-fighting equipment and techniques, there still exists a need for further technological improvements which can help to better protect petrochemical and other large, outdoor, industrial installations from fire.

OBJECTS AND ADVANTAGES

There has been summarized above, rather broadly, the prior art that is related to the present invention in order that the context of the present invention may be better understood and appreciated. In this regard, it is instructive to also consider the objects and advantages of the present invention.

It is an object of the present invention to provide apparatus and methods that are effective at fighting fires in large, outdoor, industrial installations.

It is another object of the present invention to provide apparatus and methods that are effective at fighting fires in industrial petrochemical installations.

It is yet another object of the present invention to demonstrate how existing fire-fighting equipment may be combined into unique systems which can provide the best means yet devised to address fires in large outdoor installations.

It is a further object of the present invention to provide a means for remotely operating fire-fighting equipment from a distant location using closed circuit television.

These and other objects and advantages of the present invention will become readily apparent as the invention is better understood by reference to the accompanying summary, drawings and the detailed description that follows.

SUMMARY OF THE INVENTION

Recognizing the need for the development of improved fire suppression systems and methods, the present invention is generally directed to satisfying the needs set forth above and overcoming the disadvantages identified with prior art devices and methods.

In accordance with the present invention, the foregoing need can be satisfied by providing an operator-directed system for suppressing fire within a remote, outdoor, industrial installation. In a preferred embodiment of this invention, such a system includes: (a) a means for capturing at a prescribed frequency video images of the remote area, (b) a means of transmitting these images to the operator's location which is some distance from the remote location, (c) a means, adapted to utilize these transmitted images, for detecting fire within the remote area, (d) a means located at the remote location for discharging a fire suppressant over the area, and (e) a means, located at the operator's location and utilizing the transmitted images, for allowing the operator to control the flow and direction of the discharging of the fire suppressant in the remote area.

In another preferred embodiment, the present invention takes the form of an operator-directed method for suppressing fire within a prescribed area that is remote from the location of the operator. This method includes the steps of: (a) capturing, at a prescribed frequency, video images of the remote area, (b) transmitting these captured images to the operator's location, (c) utilizing these captured images to detect the occurrence of a fire within the remote area, (d) discharging, upon the detection of the occurrence of a fire in the remote area, a fire suppressant over the prescribed area, wherein the operator utilizes the transmitted, captured images to control the discharging of the fire suppressant.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

DESCRIPTION OF THE PREFERRED EMBODIMENT

Figure 1:
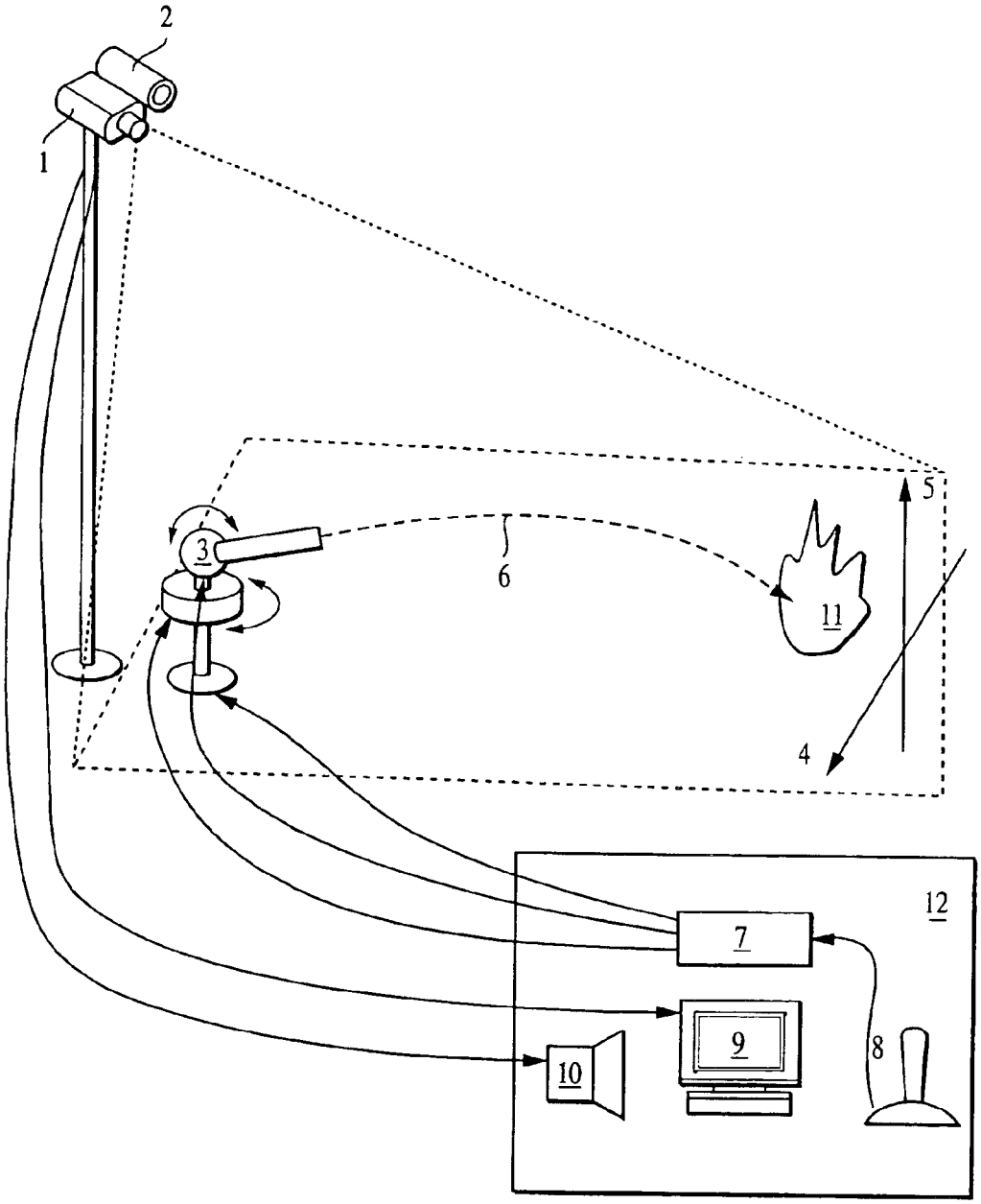
FIG. 1 shows a preferred embodiment of the fire suppression method and apparatus of the present invention.

Before explaining at least one embodiment of the present invention in detail, it is to be understood that this invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows a preferred embodiment of the fire suppression method and system of the present invention. This fire suppression system includes: at least one television camera 1 and fire detector 2 mounted at a location that provides a good view of the area under protection. These are connected to a remote monitoring station 12 which has a means of displaying the live images from the television camera, such as television monitor 9. This station also includes a means of operator notification in the event of fire, such as sound alarm 10. A manipulator, such as joystick 8, is connected to a control unit 7 that provides the remote controls in horizontal 4 and vertical planes 5 for directing the fire suppressant materials 6 that flow from a water or foam gun 3 towards any flames 11.

The fire suppression method of the present invention is generally seen to include the steps of: (a) detecting the presence of the flames with the fire detector, (b) notifying the remotely located system operator of the presence of flames in the monitored area, (c) providing the instant television images of the fire scene to the operator so as to aid the operator in pointing the flow of fire suppressant materials towards the detected flames, (d) providing at the monitored area a remotely controlled water gun or foam dispenser which is used to direct the flow of fire suppressant materials towards the flames.

Figure 2:
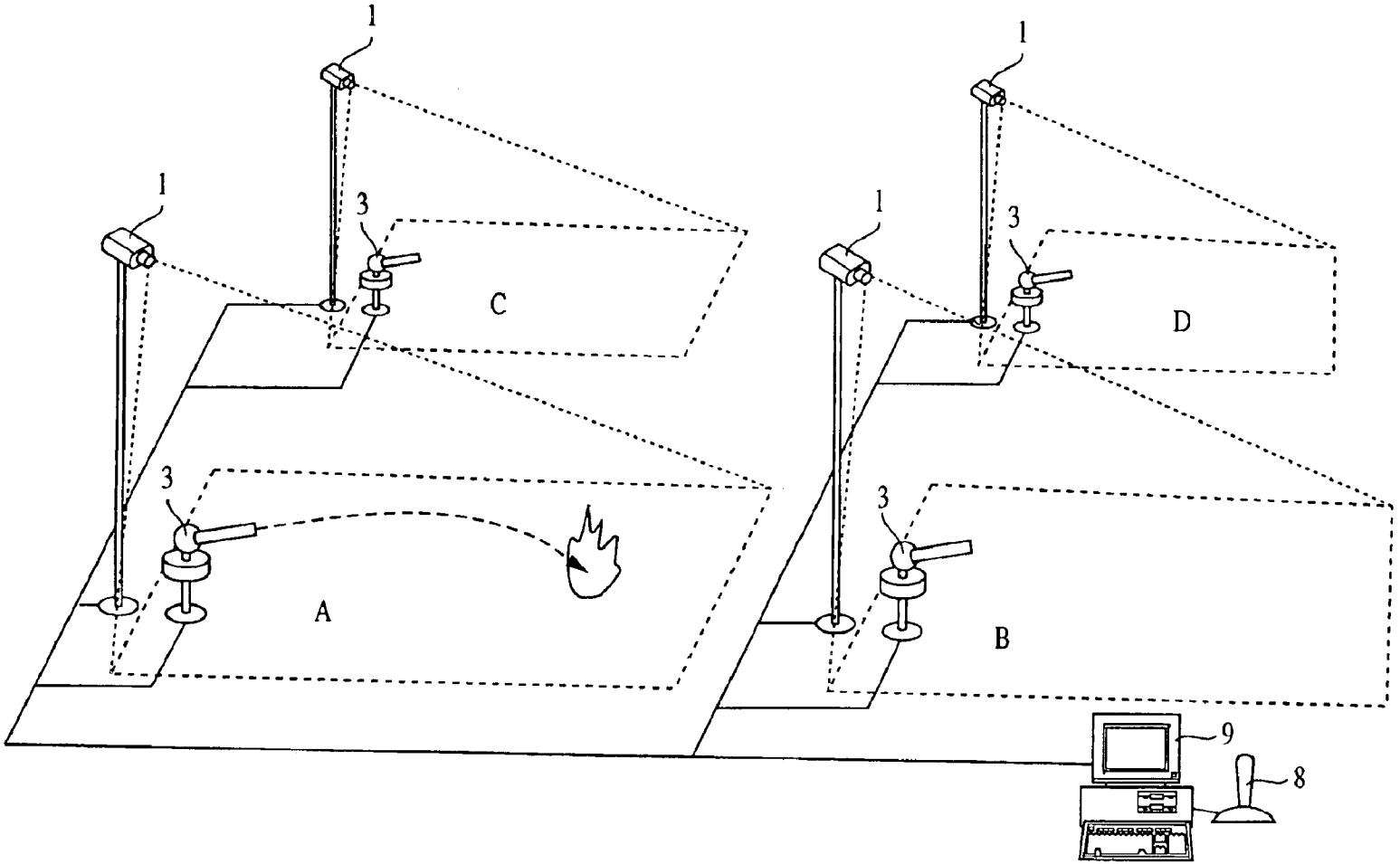
FIG. 2 shows another preferred embodiment in which four distinct areas are being protected by a version of the present invention.

In another preferred embodiment, the fire suppression system is configured so as to allow it to monitor a number of separate, protected areas at the same time, such as the four areas A–D depicted in FIG. 2. Each of the separate protected areas has its own computerized television camera 1. These video cameras are capable of detecting fire by analyzing the video images using an imaging algorithm, such as that disclosed in U.S. Pat. No. 6,184,792 which issued on Feb. 6, 2001 to one of the present inventors. The teachings within this patent are hereby included by reference into the disclosure of the present invention, especially those parts which describe how to make and operate the fire detector that is a part of the present invention.

Each of the separate protected areas also has its own digitally controlled water gun or foam dispenser 3 that is connected into a digital communication network which has its control center in the remote operator workstation.

The advantage of such an arrangement is that one operator is able to monitor and protect a number of installations simultaneously and even handle multiple fires by instantly switching the controls for the water gun from affected area to another. In addition, such an arrangement requires much less wiring and generally is more reliable, since the integrity of the video digital communication network can be monitored constantly.

Since the elements that make up the present invention, except for the fire detector which is described in U.S. Pat. No. 6,184,792, are well known in the art, no further description of these elements will be provided herein.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as will later be set forth in the claims of the regular patent application that will be filed to protect the present invention.

What is claimed is:

1. An operator-directed system for suppressing fire within a prescribed area that is remote from the location of said operator, said system comprising:

a means for capturing, at a prescribed frequency, video images of said remote area, a means for transmitting said captured images to the location of said operator, a means, adapted to utilize said captured images, for detecting the occurrence of a fire within said remote area, a means, located at said remote location, for discharging a fire suppressant over said prescribed area, and a means, located at the location of said operator and utilizing said transmitted, captured images, for allowing said operator to control the operation of said remote means for discharging said fire suppressant.

2. An operator-directed system for suppressing fire as recited in claim 1, further comprising:

a means, responsive to the detection of the occurrence of a fire in said remote area, for informing said operator of said fire detection.

3. An operator-directed system for suppressing fire as recited in claim 1, further comprising:

a means, at the location of said operator, for displaying said transmitted, captured images, wherein said image display means is connected to said fire suppressant discharging means and is adapted to be utilized by said operator in controlling said fire suppressant discharging means.

4. An operator-directed system for suppressing fire as recited in claim 2, further comprising:

a means, at the location of said operator, for displaying said transmitted, captured images, wherein said image display means is connected to said fire suppressant discharging means and is adapted to be utilized by said operator in controlling said fire suppressant discharging means.

5. An operator-directed system for suppressing fire as recited in claim 1, wherein said fire detection means is adapted to provide image analysis of said captured images.

6. An operator-directed system for suppressing fire as recited in claim 2, wherein said fire detection means is adapted to provide image analysis of said captured images.

7. An operator-directed system for suppressing fire as recited in claim 3, wherein said fire detection means is adapted to provide image analysis of said captured images.

8. An operator-directed system for suppressing fire as recited in claim 4, wherein said fire detection means is adapted to provide image analysis of said captured images.

9. An operator-directed method for suppressing fire within a prescribed area that is remote from the location of said operator, said method comprising the steps of:

capturing, at a prescribed frequency, video images of said remote area, transmitting said captured images to the location of said operator, utilizing said captured images to detect the occurrence of a fire within said remote area, discharging, upon the detection of the occurrence of a fire in said remote area, a fire suppressant over said prescribed area, wherein said operator utilizes said transmitted, captured images to control the discharging of said fire suppressant.

10. An operator-directed method for suppressing fire as recited in claim 9, further comprising the step of initiating an alarm, responsive to the detection of the occurrence of a fire in said remote area, to inform said operator of said fire detection.

11. An operator-directed method for suppressing fire as recited in claim 9, further comprising the steps of:

displaying, at the location of said operator, said transmitted, captured images, and utilizing said displayed images to enable said operator to control the discharging of said fire suppressant.

12. An operator-directed method for suppressing fire as recited in claim 10, further comprising the steps of:

displaying, at the location of said operator, said transmitted, captured images, and utilizing said displayed images to enable said operator to control the discharging of said fire suppressant.

13. An operator-directed method for suppressing fire as recited in claim 9, wherein said fire detection step utilizes image analysis of said captured images.

14. An operator-directed method for suppressing fire as recited in claim 10, wherein said fire detection step utilizes image analysis of said captured images.

15. An operator-directed method for suppressing fire as recited in claim 11, wherein said fire detection step utilizes image analysis of said captured images.

16. An operator-directed method for suppressing fire as recited in claim 12, wherein said fire detection step utilizes image analysis of said captured images.

* * * * *